US011072839B2

(12) United States Patent
Hamide et al.

(10) Patent No.: US 11,072,839 B2
(45) Date of Patent: Jul. 27, 2021

(54) PROCESS AND DEVICE FOR COOLING A METAL SUBSTRATE

(71) Applicant: ArcelorMittal, Luxembourg (LU)

(72) Inventors: Makhlouf Hamide, Thionville (FR); Charles Romberger, Kinzers, PA (US); Jean-Luc Borean, Florange (FR); Marie-Christine Régnier, Woippy (FR)

(73) Assignee: ARCELORMITTAL, Luxembourg (LU)

( * ) Notice: Subject to any disclaimer, the term of this patent is extended or adjusted under 35 U.S.C. 154(b) by 147 days.

(21) Appl. No.: 15/779,961

(22) PCT Filed: Dec. 29, 2016

(86) PCT No.: PCT/EP2016/082887
§ 371 (c)(1),
(2) Date: May 30, 2018

(87) PCT Pub. No.: WO2017/114927
PCT Pub. Date: Jul. 6, 2017

(65) Prior Publication Data

US 2018/0355456 A1 Dec. 13, 2018

(30) Foreign Application Priority Data

Dec. 30, 2015 (WO) ..... PCT/IB2015/060051

(51) Int. Cl.
*C21D 11/00* (2006.01)
*B21B 45/02* (2006.01)
(Continued)

(52) U.S. Cl.
CPC ..... *C21D 11/005* (2013.01); *B21B 45/0218* (2013.01); *C21D 1/667* (2013.01); *C21D 9/573* (2013.01)

(58) Field of Classification Search
CPC ..... C21D 11/005; C21D 1/667; C21D 9/573; B21B 45/0218
See application file for complete search history.

(56) References Cited

U.S. PATENT DOCUMENTS 5,694,799 A * 12/1997 Wolpert ..... B21B 27/10 72/201
2006/0060271 A1 3/2006 Fujibayashi et al.
(Continued)

FOREIGN PATENT DOCUMENTS

CN 202185466 U 4/2012
CN 102513383 A 6/2012
(Continued)

OTHER PUBLICATIONS

Lee et al. ("The effect of nozzle height on cooling heat transfer from a hot steel plate by an impinging liquid jet." ISIJ international 44.4 (2004): 704-709.). (Year: 2004).*
(Continued)

*Primary Examiner* — Anthony J Zimmer
*Assistant Examiner* — Ricardo D Morales
(74) *Attorney, Agent, or Firm* — Davidson, Davidson & Kappel, LLC

(57) ABSTRACT

A process for cooling a metal substrate running in a longitudinal direction, said process including ejecting at least one first cooling fluid jet on a first surface of said substrate and at least one second cooling fluid jet on a second surface of said substrate, said first and second cooling fluid jets being ejected at a cooling fluid velocity higher than or equal to 5 m/s, so as to form on said first surface and on said second surface a first laminar cooling fluid flow and a second laminar flow respectively, said first and second laminar cooling fluid flows being tangential to the substrate, said first and second laminar cooling fluid flows extending over a first predetermined length and a second predetermined length of
(Continued)

the substrate respectively, said first and second lengths being determined so that the substrate is cooled from a first temperature to a second temperature by nucleate boiling.

15 Claims, 7 Drawing Sheets

(51) Int. Cl.
*C21D 9/573* (2006.01)
*C21D 1/667* (2006.01)

(56) References Cited

U.S. PATENT DOCUMENTS

| | | | | |
|---|---|---|---|---|
| 2007/0175255 | A1* | 8/2007 | Pawelski | B08B 3/022 72/201 |
| 2009/0126439 | A1 | 5/2009 | Satoshi et al. | |
| 2010/0192658 | A1* | 8/2010 | Ueoka | C21D 9/573 72/342.5 |
| 2012/0068391 | A1 | 3/2012 | Eto et al. | |

FOREIGN PATENT DOCUMENTS

| | | | | |
|---|---|---|---|---|
| CN | 102756000 | A | 10/2012 | |
| CN | 204799691 | U | 11/2015 | |
| DE | 102013019619 | A1 | 5/2015 | |
| EP | 1428589 | A1 | 6/2004 | |
| JP | S59144513 | A | 8/1984 | |
| JP | 2005021984 | A | 1/2005 | |
| JP | 2006212666 | A | 8/2006 | |
| JP | 2008049397 | A | 3/2008 | |
| JP | 2008073766 | A | 4/2008 | |
| RU | 2410177 | C2 | 1/2011 | |
| RU | 2570712 | C1 | 12/2015 | |
| WO | 2015075041 | A1 | 5/2015 | |
| WO | WO-2015075041 | A1 * | 5/2015 | C21D 9/573 |

OTHER PUBLICATIONS

Edalatpour et al. ("Effect of phase transformation latent heat on prediction accuracy of strip laminar cooling." Journal of Materials Processing Technology 211.11 (2011): 1776-1782.). (Year: 2011).*
International Search Report issued in connection with International Application No. PCT/EP2016/082887 dated Mar. 29, 2017.
International Search Report issued in connection with International Application No. PCT/IB2015/060051 dated Feb. 9, 2016.
English Abstract of JPS59144513A, Aug. 18, 1984.

* cited by examiner

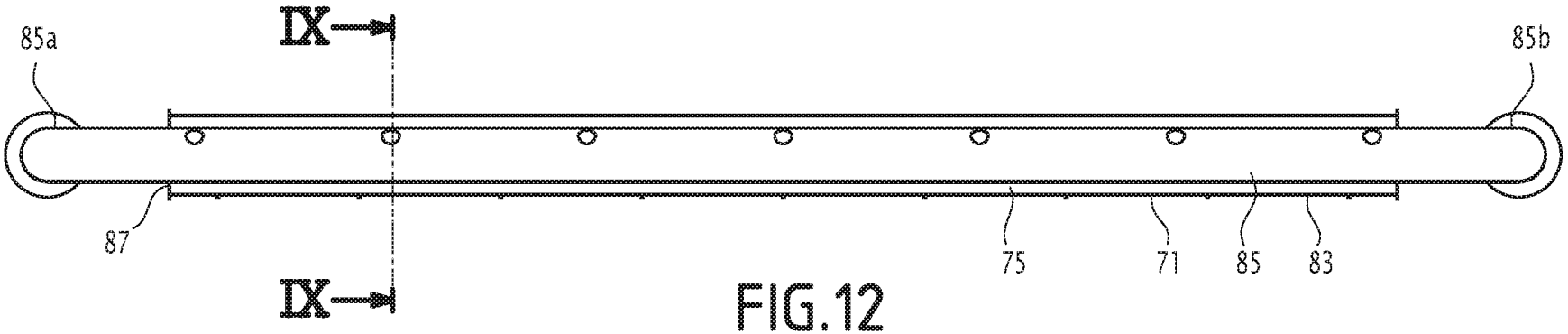
FIG.12
FIG.13
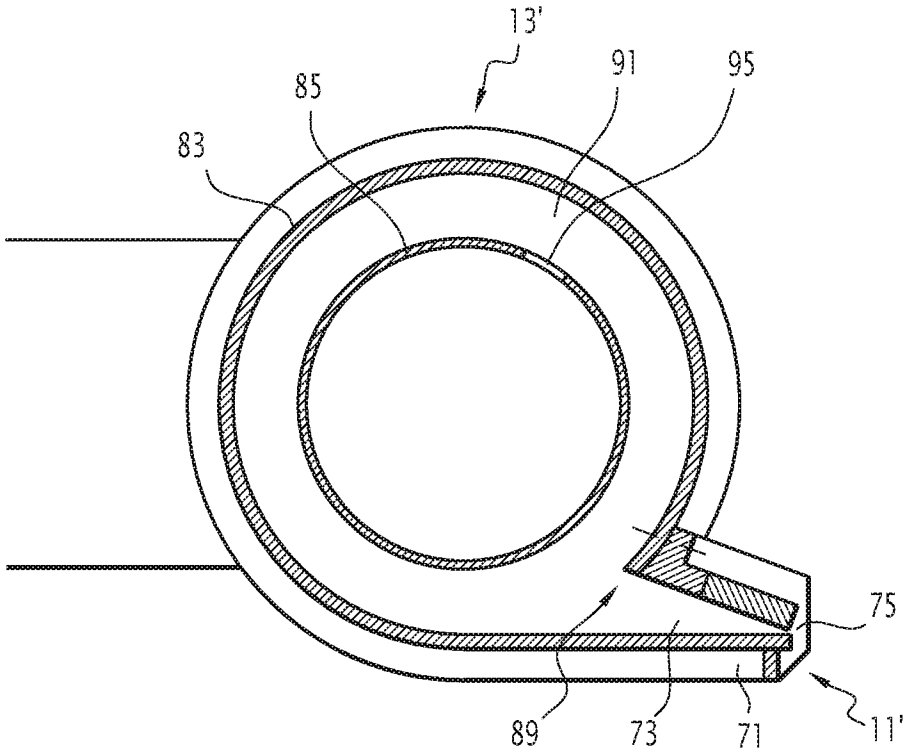

PROCESS AND DEVICE FOR COOLING A METAL SUBSTRATE

FIELD OF THE INVENTION

The present invention relates to a process for cooling a metal substrate.

The present invention also relates to the cooling of a metal substrate, for example a steel plate, during the manufacturing of this substrate, notably at the end of hot rolling or during a heat treatment of the substrate.

During such a cooling, the cooling rate has to be controlled as much as possible in order to make sure, at the end of the cooling, of obtaining the desired microstructure and mechanical properties.

BACKGROUND OF THE INVENTION

EP 1 428 589 A1 discloses a method for cooling a steel plate, wherein a cooling fluid pool is formed by injecting jets of cooling fluid from a slit nozzle on the upper surface of the plate and from tubular nozzles on the lower surface of the plate, and the steel plate is cooled by passing in this cooling fluid pool.

However, the application of such a cooling method may lead to flatness defects of the surfaces of the plate. Such defects may be caused by inhomogeneities of the cooling rate within the plate, in particular to a difference in cooling rate between the upper surface of the plate and its lower surface, and also between the surfaces and the core of the plates.

BRIEF SUMMARY OF THE INVENTION

An object of the invention is therefore to provide a process and a device for cooling a substrate which allows rapid and controlled cooling of a metal substrate without inducing temperature inhomogeneities within the substrate, in particular in the thickness of the substrate.

The present invention therefore provides a process for cooling a metal substrate running in a longitudinal direction, said process comprising ejecting at least one first cooling fluid jet on a first surface of said substrate and at least one second cooling fluid jet on a second surface of said substrate, said first and second cooling fluid jets being ejected at a cooling fluid velocity higher than or equal to 5 m/s, so as to form on said first surface and on said second surface a first laminar cooling fluid flow and a second laminar cooling fluid flow respectively, said first and second laminar cooling fluid flows being tangential to the substrate, said first and second laminar cooling fluid flows extending over a first predetermined length and a second predetermined length of the substrate respectively, said first and second lengths being determined so that the substrate is cooled from a first temperature to a second temperature by nucleate boiling.

The process according to the invention may comprise one or several of the following features, taken individually or according to any technically possible combination:

the difference between the first length and the second length is lower than 10% of the mean of the first and the second lengths;

the first cooling fluid jet and the second cooling fluid jet are symmetrical with respect to a median plane of the substrate;

said first and said second cooling fluid jets each form during their ejection a predetermined angle with the longitudinal direction, said predetermined angle being comprised between 5° and 25°;

said first and said second cooling fluid jets are ejected from a predetermined distance on said first and second surfaces respectively, said predetermined distance being comprised between 50 and 200 mm;

each of said first and second predetermined lengths is comprised between 0.2 m and 1.5 m;

said first temperature is higher than or equal to 600° C.;

said first temperature is higher than or equal to 800° C.;

said substrate is running at a speed comprised between 0.2 m/s and 4 m/s;

the mean heat flux extracted from each of the first and second surfaces during the cooling from the first temperature to the second temperature is comprised between 3 and 7 $MW/m^2$;

the substrate having a thickness comprised between 2 and 9 mm, the substrate is cooled from 800° C. to 550° C. at a cooling rate higher than or equal to 200° C./s;

each of said first and second cooling fluid jets is ejected with a specific cooling fluid flow rate comprised between 360 and 2700 $L/min/m^2$;

said metal substrate is a steel plate;

said first and second laminar cooling fluid flows extend over the width of the substrate.

The present invention also provides a method for hot-rolling a metal substrate, said method comprising hot-rolling the metal substrate, and cooling the hot-rolled metal substrate with a process according to the invention.

The present invention further provides a method for heat-treating a metal substrate, said method comprising heat-treating the metal substrate and cooling the heat-treated metal substrate with a process according to the invention.

In addition, the present invention is provides a cooling device of a metal substrate comprising:

a first cooling unit configured to eject at least one first cooling fluid jet on a first surface of the substrate, a second cooling unit configured to eject at least one second cooling fluid jet on a second surface of the substrate, the first and second cooling units being configured to eject the first and the second cooling fluid jets respectively, with a cooling fluid velocity higher than or equal to 5 m/s, so as to form on said first surface and on said second surface a first laminar cooling fluid flow and a second laminar cooling fluid flow respectively, said first and second laminar cooling fluid flows being tangential to the substrate and extending over a first predetermined length and a second predetermined length of the substrate respectively.

A cooling device according to the invention may comprise one or several of the following features, taken individually or according to any technically possible combination:

the first cooling unit comprises at least one first cooling header, configured to eject the first cooling fluid jet, and the second cooling unit comprises at least one second cooling header, configured to eject the second cooling fluid jet;

the first cooling header and the second cooling header each comprise a header nozzle comprising a nozzle opening for ejecting the first cooling fluid jet and the second cooling fluid jet respectively;

each header nozzle forms a predetermined angle with the longitudinal direction, the predetermined angle being comprised between 5° and 25°;

at least one of said first and second cooling units comprises a device for stopping the cooling fluid flow, adapted for preventing any cooling fluid flow downstream said first predetermined length and/or said second predetermined length;

each of the first and second cooling header is connected to a cooling fluid supply circuit, said cooling fluid supply circuit being fed with cooling fluid with a cooling fluid pressure comprised between 1 and 2 bars;

each cooling fluid supply circuit is configured so that cooling fluid circulates in the cooling fluid supply circuit at a velocity of at most 2 m/s.

The present invention also provides a hot rolling installation comprising a cooling device according to the invention.

The present invention further provides a heat treatment installation comprising a cooling device according to the invention.

BRIEF DESCRIPTION OF THE DRAWINGS

The invention will be better understood upon reading the description which follows, only given as an example and made with reference to the appended drawings, wherein:

FIG. 12 is a partly cut away schematic illustration, seen from the front, of an assembly formed by a cooling header and a supplying circuit of a cooling module according to another embodiment;

FIG. 13 is a sectional view, along the plane IX-IX of FIG. 12, of the assembly of FIG. 12.

DETAILED DESCRIPTION OF THE INVENTION

Figure 1:
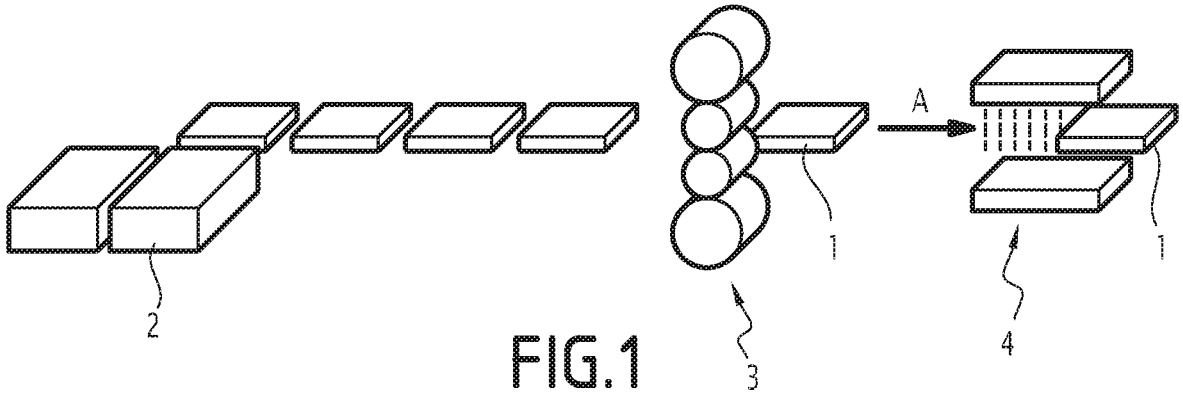
FIG. 1 is a schematic illustration of a hot-rolling line including a cooling apparatus according to an embodiment of the invention.

FIG. 1 illustrates a metal substrate 1 which, on discharge from a furnace 2 and a rolling mill 3, is moved in a running direction A. For example, the running direction A of the substrate 1 is substantially horizontal.

The substrate 1 then passes through a cooling apparatus 4, in which the substrate is cooled from an initial temperature, which is for example substantially equal to the temperature at the end of the rolling of the substrate, down to a final temperature which is for example room temperature, i.e. about 20° C.

The substrate 1 passes through the cooling apparatus 4 in the running direction A at a running speed which is preferably comprised between 0.2 and 4 m/s.

The substrate 1 is for example a metal plate having a thickness comprised between 3 and 110 mm.

The initial temperature is for example greater than or equal to 600° C., notably greater than or equal to 800° C., or even greater than 1000° C.

In the cooling apparatus 4, at least one first cooling fluid jet is ejected on a first surface of the substrate 1, and at least one second cooling fluid jet is ejected on a second surface of the substrate 1. The cooling fluid is for example water.

The first and second cooling fluid jets are ejected in the running direction A at a cooling fluid velocity higher than or equal to 5 m/s, so as to form on the first surface and on the second surface a first laminar cooling fluid flow and a second laminar cooling fluid flow respectively.

The first and second cooling fluid jets are preferably emitted with a specific cooling fluid flow rate comprised between 360 and 2700 L/min/m2.

The ejection velocity of the first and second cooling fluid jets is for example less than or equal to 20 m/s, and more preferably less than or equal to 12 m/s.

Preferably, the ejection velocity of the first cooling fluid jet and the ejection velocity of the second cooling fluid jet are substantially equal.

The ejection velocity of the cooling fluid jets is expressed here in an absolute way, i.e. with respect to an immobile part of the cooling apparatus 4, and not with respect to the running substrate 1.

The inventors actually discovered that if the ejection of first and second cooling fluid jets at a velocity is greater than or equal to 5 m/s, a laminar flow of cooling fluid can be obtained on both first and second surfaces, over a length of at least 0.2 m, generally of at least 0.5 m, up to 1.5 m. In particular, when the substrate 1 runs in a horizontal plane, a laminar flow of cooling fluid can be obtained on the first and second surfaces over a length of at least 0.2 m, generally of at least 0.5 m, up to 1.5 m, in spite of the force of gravity being exerted on the cooling fluid flowing on the second surface, which is a lower surface.

Preferably, the first cooling fluid jet and the second cooling fluid jet impact the first and second surfaces respectively on lines of impact which are symmetrical with respect to a median plane of the substrate 1, i.e. a longitudinal plane parallel to the first and second surfaces of the substrate 1 and located at half-distance from these first and second surfaces.

The first and second laminar cooling fluid flows are tangential to the substrate 1 and extend over the width of the substrate 1. Furthermore, the first and second laminar cooling fluid flows each extend over a predetermined length of the substrate 1. In particular, the first laminar cooling fluid flow extends over a first predetermined length L1 of the substrate 1, and the second cooling fluid flow extends over a second predetermined length L2 of the substrate.

The first predetermined length L1 and the second predetermined length L2 are similar. In particular, the difference between the first predetermined length L1 and the second predetermined length L2 is lower than 10% of the mean of the first and the second predetermined lengths.

This symmetry of the first and second cooling fluid jets, combined with the cooling fluid velocity, allows forming cooling fluid flows on the first surface and on the second surface which are substantially symmetrical with respect to a median plane of the substrate 1, and thus obtaining a homogenous cooling of the substrate 1 in its thickness.

The first and second predetermined lengths L1 and L2 are determined so that the substrate 1 is cooled from a first temperature to a second temperature by nucleate boiling.

Preferably, each of the first and second predetermined lengths L1, L2 are comprised between 0.2 m and 1.5 m, more preferably between 0.5 m and 1.5 m.

Nucleate boiling is to be distinguished from transition boiling and film boiling.

Film boiling generally occurs, when cooling a substrate, at high temperatures of this substrate, i.e. when the temperature of the surfaces of the substrate is higher than a higher temperature threshold. Nucleate boiling occurs at low temperatures of the substrate, i.e. when the temperature of the surfaces of the substrate is lower than a lower temperature threshold. Transition boiling occurs at intermediate temperatures, in particular when the temperature of the surfaces of the substrate is comprised between the lower and the higher temperature thresholds.

In transition boiling, the heat flow extracted during the cooling is a decreasing function of temperature. Consequently, the areas with the lowest temperatures of the substrate are cooled more rapidly than the remainder of the substrate. In particular, in transition boiling, inhomogeneities in the temperatures of the two surfaces of the substrate result in a difference in the cooling rate between the surfaces, which tends to enhance the initial inhomogeneities of the temperature of the substrate.

These temperature inhomogeneities generate, in the substrate, asymmetrical internal constraints, which in turn cause deformation of the substrate and flatness defects of the surfaces of the substrate.

On the contrary, in nucleate boiling, the heat flow extracted during the cooling is an increasing function of the temperature. Consequently, the coldest areas of the substrate are cooled more slowly, which results in an attenuation of the temperature inhomogeneities of the substrate.

Generally, the cooling of a substrate is initiated in transition boiling, which tends to exacerbate the temperature inhomogeneities of the substrate.

However, the inventors have discovered that ejecting on each surface of the substrate a cooling fluid jet at a cooling fluid velocity higher than or equal to 5 m/s, so as to form on each surface of the substrate a laminar cooling fluid flow which is tangential to the substrate and extends over a predetermined length, allows cooling the substrate in nucleate boiling from high temperatures, in particular from temperatures which can be higher than 600° C., and even higher than 800° C. or 1000° C.

Thus, the substrate 1 is exclusively cooled under conditions which tend to attenuate the temperature inhomogeneities which the substrate 1 may present before its cooling.

The first and said second cooling fluid jets form during their ejection a predetermined angle with the longitudinal direction, which is preferably comprised between 5° and 25°. Moreover, the first and second cooling fluid jets are ejected from a predetermined distance from the first and second surfaces respectively, this predetermined distance being preferably comprised between 50 and 200 mm.

Indeed, the inventors have found that an angle comprised between 5° and 25° and/or a predetermined distance comprised between 50 and 200 mm promote the formation of a laminar cooling fluid flow on each surface of the substrate, and provide high cooling rates. In particular, during the cooling of the substrate from the first temperature to the second temperature, the mean heat flux extracted from each surface is for example comprised between 3 and 7 MW/m2.

Especially, the inventors have discovered that an angle comprised between 5° and 25° allows forming of a laminar cooling fluid flow on each surface of the substrate and allows cooling the substrate in nucleate boiling from high temperatures. By contrast, the inventors have found that if the angle with the longitudinal direction formed by the first and/or second cooling fluid jets during their ejection is higher than 25°, a backflow of fluid occurs in the direction opposite the running direction A of the substrate. This backflow disturbs the flow of cooling fluid, which is consequently not laminar. As a result, the substrate is not cooled by nucleate boiling.

For example, when the substrate has a thickness comprised between 2 and 9 mm, the substrate may be cooled from 800° C. to 550° C. at a cooling rate higher than or equal to 200° C./s.

Figure 4:
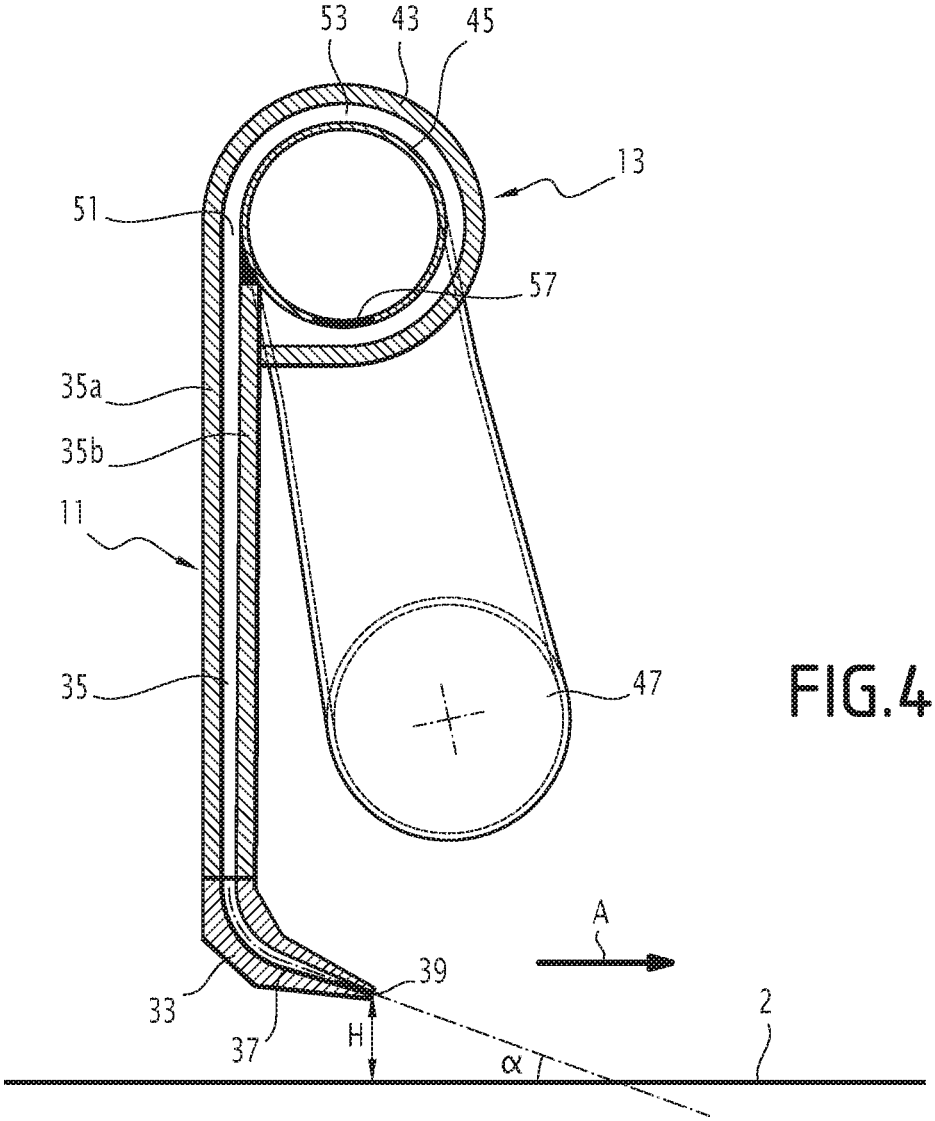
FIG. 4 is a sectional view, along the plane IV-IV of FIG. 3, of the assembly of FIG. 3.
Figure 2:
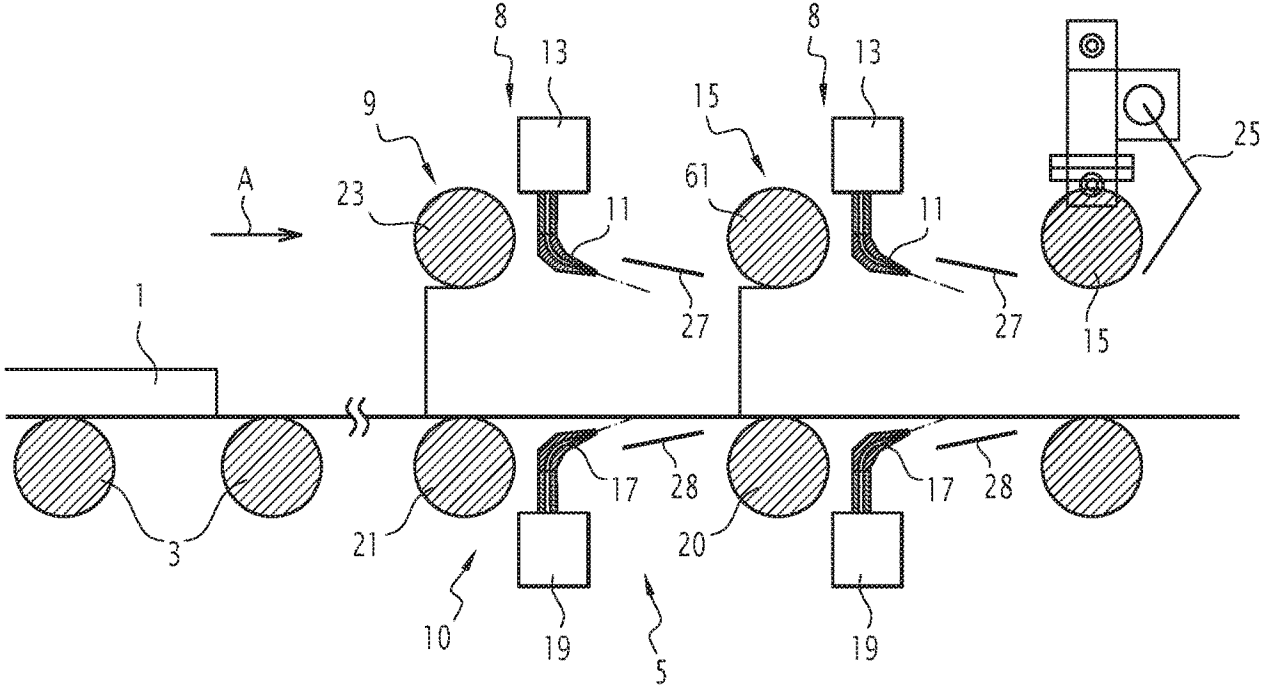
FIG. 2 is a schematic illustration of a cooling module of the cooling apparatus of FIG. 1.
Figure 3:
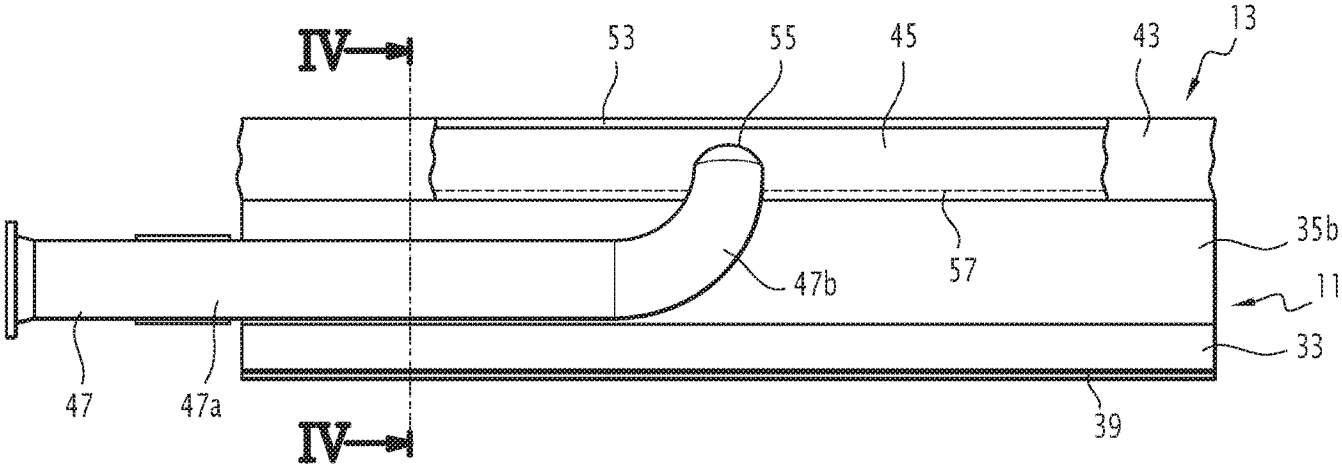
FIG. 3 is a partly cutaway schematic illustration, seen from the front, of an assembly formed by a cooling header and a supplying circuit of the cooling module of FIG. 2.

A cooling apparatus 4 according to an embodiment of the invention is illustrated in more details on FIGS. 2, 3 and 4.

In the example illustrated, the substrate 1 is running horizontally, so that the first surface of the substrate 1 is an upper surface, oriented upwards during the running of the substrate 1, and the second surface of the substrate 1 is a lower surface, oriented downwards during the running of the substrate 1, and supported on rollers.

In all the following, the selected orientations are indicative and are meant with respect to the Figures. In particular, the terms of "upstream" and "downstream" are meant relatively to the orientation selected in the Figures. These terms are used with respect to the running substrate 1. Moreover, the terms of "transverse", "longitudinal" and "vertical" should be understood with respect to the running direction A of the substrate 1, which is a longitudinal direction. In particular, the term of "longitudinal" refers to a direction parallel to the running direction A of the substrate 1, the term of "transverse" refers to a direction orthogonal to the running direction A of the substrate 1 and contained in a plane parallel to the first and second surfaces of the substrate 1, and the term of "vertical" refers to a direction orthogonal to the running direction A of the substrate 1 and orthogonal to the first and second surfaces of the substrate 1.

Furthermore, by "length" a dimension of an object in the longitudinal direction will be referred to, by "width" a dimension of an object in a transverse direction, and by "height" a dimension of an object in a vertical direction.

The apparatus 4 illustrated on FIG. 2 comprises at least one cooling module 5, the cooling module 5 comprising a predefined number of cooling devices 8.

Each cooling device 8 is configured for allowing running of the substrate 1 in the running direction A, and for cooling the substrate 1, during this running, from a first temperature down to a second temperature, in nucleate boiling.

In particular, as described in more detail hereafter, each cooling device 8 is configured for generating a laminar flow of cooling fluid on the first surface and on the second surfaces of the substrate 1, this laminar flow extending over the whole width of the substrate 1 and over a predetermined length L1, L2 of the substrate 1, along the running direction A of the substrate 1.

For this purpose, each cooling device 8 is configured for ejecting a first cooling fluid jet onto the first surface of the substrate 1 and a second cooling fluid jet on the second surface of the substrate 1, the ejection velocity of the first and second cooling fluid jets being greater than or equal to 5 m/s.

In the illustrated example, the cooling module 5 comprises two cooling devices 8 which follow each other in the running direction A of the substrate 1.

A first device 8 is thus intended for cooling the substrate 1 from a first temperature down to a second temperature, and a second device 8, placed downstream from the first device 8 in the running direction of the substrate 1, is intended for cooling the substrate 1 from the second temperature down to a third temperature.

Each cooling device 8 comprises a first unit 9 and a second unit 10.

The first unit 9, which is intended to be positioned in front of the first surface of the substrate 1 during its cooling, in this example above the substrate, is configured for generating a laminar flow of cooling fluid on the first surface of the substrate 1, this laminar flow extending over the whole width of the substrate 1 and over the first predetermined length L1 of the substrate 1.

The second unit 10, which is intended to be positioned in front of the second surface of the substrate 1 during its cooling, in this example below the substrate, is configured for ensuring running of the substrate 1 and for generating a laminar flow of cooling fluid on the second surface of the substrate 1, this laminar flow extending over the whole width of the substrate 1 and over the second predetermined length L2 of the substrate 1.

For this purpose, the first unit 9 comprises a first cooling header 11, a circuit 13 for the cooling fluid supply of the first cooling header 11, schematically illustrated in FIG. 2 and in more detail in FIGS. 3 and 4, and a device 15 for stopping the flow of cooling fluid, adapted for stopping the flow of cooling fluid generated by the first cooling header 11 and thereby avoiding that this cooling fluid flow extends over a length of the substrate 1 greater than the predetermined length.

The second unit 10 of the cooling device 8 comprises, similarly to the first unit 9, a second cooling header 17 and a circuit 19 for supplying cooling fluid to the second cooling header 17. The second unit 10 further comprises a second roller 20 configured for ensuring running of the substrate 1.

The first cooling header 11 and the second cooling header 17 are substantially symmetrical with respect to the median plane of the substrate 1 during the application of the cooling process.

Also, the supply circuits 13 and 19 are substantially symmetrical with respect to the median plane of the substrate 1 during the application of the cooling process.

Subsequently, the first cooling header 11 and the supply circuit 13 will be described with reference to FIGS. 3 and 4, it being considered that this description is applicable, by symmetry, to the second cooling header 17 and to the supply circuit 19.

Preferably, the first device 8 of the cooling module 5 comprises, in addition to the first 9 and second 10 units, two upstream rollers, including a first upstream roller 23 and a second upstream roller 21. The upstream rollers 21 and 23 are positioned upstream from the first 9 and second 10 units of the first device 8, with respect to the running direction of the substrate 1.

The second upstream roller 21 is intended for ensuring running of the substrate 1.

The first upstream roller 23 is of a general cylindrical shape, and extends transversely over the whole width of the substrate 1.

The first upstream roller 23 is configured so as to come into contact with the running first surface of the substrate 1, so as to prevent cooling fluid flow from the cooling module 5 towards the upstream side of the substrate 1. The first upstream roller 23 further is a safety device intended to prevent possible contact between the substrate 1 and the first cooling header 11.

Furthermore, the last device of the cooling module 5, which in the described example is the second device 8, comprises an additional device 25 for stopping the cooling fluid flow, adapted for preventing any cooling fluid flow downstream from the cooling module 5.

Each device 8 further comprises an upper deflector 27 and a lower deflector 28, which are configured to channel and control the cooling fluid runoff downstream the device 8. In particular, the upper deflector 27 prevents running cooling fluid, stopped by the device 15, from flowing back on the substrate 1.

The first cooling header 11 and the associated supply circuit 13 are schematically illustrated on FIGS. 3 and 4.

FIG. 3 is a front view, along a direction opposite to the running direction A, partly cut away, of the assembly formed by the first cooling header 11 and the supply circuit 13, and FIG. 4 is a sectional view, along the plane IV-IV of FIG. 3, of the assembly illustrated on FIG. 3.

The first cooling header 11 is supplied with pressurized cooling fluid via the supply circuit 13, and is configured to eject at least one first cooling fluid jet on the first surface of the substrate 1. This cooling fluid jet is preferably a continuous jet transversely extending over the whole width of the substrate 1.

The first cooling header 11 comprises a header nozzle 33 and a channel 35.

The header nozzle 33 extends in a transverse direction with respect to the running substrate 1, over a width greater than or equal to the width of the substrate 1 to be cooled.

The header nozzle 33 is provided with a through-orifice forming a conduit 37 for conveying cooling fluid. The conduit 37 transversely extends over a width greater than or equal to that of the substrate 1 to be cooled, and extends in a vertical longitudinal plane between an upstream end, connected to the channel 35, and a downstream end. The downstream end forms an aperture, through which cooling fluid, injected by the supply circuit 13 and crossing the channel 35 and then the conduit 37, is ejected as a cooling fluid jet on the substrate 1.

The aperture forms a continuous slot or opening 39 extending in a transverse direction with respect to the running substrate 1. The opening 39 has a width greater than or equal to that of the substrate 1 to be cooled.

Preferably, the conduit 37 has a decreasing section from the upstream side to the downstream side of the conduit 37, which allows the formation at the outlet of the opening 39, of a cooling fluid jet ejected at a velocity of at least 5 m/s, from an initial velocity of the cooling fluid, in the supply circuit 13, of less than 2 m/s. Indeed, as described hereafter, circulation of the cooling fluid in the supply circuit 13 at a velocity of less than 2 m/s allows the minimization of the pressure losses in this supply circuit 13, and thus reduction in the pressure required for supplying the circuit 13.

Preferably, the downstream end of the conduit 37 forms an angle $\alpha$ with the running direction A which is comprised between 5° and 25°, notably between 10° and 20°. Thus, during the ejection of a cooling fluid jet by the first cooling header 11, this cooling fluid jet forms with the running direction A an angle $\alpha$ comprised between 5° and 25°, notably between 10° and 20°.

Such an angle α allows obtaining a laminar flow of cooling fluid on the substrate 1 and contributes to reach a rapid cooling rate of the substrate 1. Indeed, as explained above, an angle α higher than 25° would produce a backflow of fluid in the direction opposite the running direction A of the substrate. This backflow would disturb the flow of cooling fluid, which would, as a result, not be laminar.

Moreover, the first cooling header 11 is configured so as to be positioned above the running substrate 1 so that upon cooling of the substrate 1, the opening 39 is positioned at a predetermined distance H from the first surface of the substrate 1.

The distance H is preferably comprised between 50 and 200 mm.

Owing to the positioning of the opening 39 at a predetermined distance H from the surface of the substrate 1, the velocity of the cooling fluid jet upon its impact with the substrate 1 can be controlled. In particular, the cooling fluid flow on the surface of the substrate 1 remains laminar, and this flow of cooling fluid has a sufficient velocity over the predetermined length L for obtaining rapid cooling of the substrate 1.

The channel 35 is configured for conveying cooling fluid provided by the supply circuit 13 as far as the header nozzle 33.

The channel 35 extends in a transverse direction over a width substantially equal to that of the opening 39, and extends in a substantially vertical direction between an upstream end, intended to be connected to the supply circuit 13, and a downstream end, connected to the upstream end of the conduit 37. Thus, the channel 35 extends the conduit 37 in a substantially vertical direction.

The channel 35 is delimited by two substantially vertical transverse walls 35*a*, 35*b*.

Preferably, the channel 35 has a substantially constant section between its upstream end and its downstream end. Notably, both transverse walls 35*a*, 35*b* of the channel 35 are parallel.

The supply circuit 13 is intended to convey a cooling fluid flow received from a cooling fluid distribution network as far as the first cooling header 11.

The supply circuit 13 comprises, from downstream to upstream, a supply conduit 43 of the cooling header 11, a distribution conduit 45, and a main conduit 47 for providing cooling fluid. Thus, a cooling fluid flow received from the cooling fluid distribution network is conveyed by the main conduit 47, and then by the distribution conduit 45, and then by the supply conduit 43, as far as the cooling header 11, in particular as far as channel 35.

The supply conduit 43 is intended to supply cooling fluid to the channel 35.

The supply conduit 43 extends transversely over a width substantially equal to that of the channel 35. The supply conduit 43 has a general cylindrical shape, and comprises a substantially cylindrical side wall and two end walls. Thus, both ends of the supply conduit 43 are closed.

The supply conduit 43 comprises on its side wall, a substantially circular aperture allowing the passing of the main conduit 47, as described hereafter.

The supply conduit 43 moreover comprises on its side wall, a transverse aperture 51 connected to the upstream end of the channel 35. The aperture 51 extends transversely over substantially the whole of the width of the supply conduit 43.

Preferably, the aperture 51 is defined between a first transverse edge of the supply conduit 43, connected to the upper edge of a first wall 35*a* of the channel 35, and a second transverse edge, connected to the second wall 35*b* of the channel 35, at a distance from the upper edge of this second wall 35*b*.

The distribution conduit 45 is intended to distribute over the whole width of the supply conduit 43 a cooling fluid flow provided by the main conduit 47 for providing cooling fluid.

The distribution conduit 45 extends transversely over a width substantially equal to that of the channel 35 and to that of the supply conduit 43, inside the supply conduit 43.

The distribution conduit 45 is of a general cylindrical shape, and comprises a substantially cylindrical side wall and two end walls. Both ends of the distribution conduit 45 are therefore closed.

The side wall of the distribution conduit 45 defines with the side wall of the supply conduit 43 a space 53 for circulation of cooling fluid inside the supply conduit 43. The space 53 is generally ring-shaped.

The distribution conduit 45 comprises on its side wall, a substantially circular aperture 55 allowing connection with the main conduit 47, as described hereafter. The aperture 55 is aligned with the corresponding aperture made on the side wall of the supply conduit 43.

Preferably, these apertures are positioned at half-distance from the ends of the conduits 33 and 35.

The side wall of the distribution conduit 45 is moreover provided with a plurality of orifices 57 intended to allow distribution of cooling fluid comprised in the distribution conduit 45 into the space 53 of the supply conduit 43.

The orifices 57 are for example aligned in a transverse direction, and extend over the whole width of the distribution conduit 45.

The orifices 57 are for example equidistant.

The orifices 57 thus allow ensuring distribution of cooling fluid from the distribution 45 into the supply conduit 43 which is uniform along the transverse direction.

Preferably, as illustrated on FIG. 4, the side wall of the distribution conduit 45 is joined up with the upper edge of the second wall 35*b* of the channel 35, and the orifices 57 are positioned on a lower portion of the distribution conduit 45, facing the second wall 35*b* of the channel 35.

In this way, the space 53 of the supply conduit 43 forms a unidirectional channel for conveying cooling fluid from the orifices 57 as far as the channel 35.

Such an arrangement ensures uniform distribution of cooling fluid in the whole of the space 53 of the conduit 43 along the transverse direction, and allows minimization of pressure drops inside the conduit 43.

The main conduit 47 for providing cooling fluid is configured to be connected to the cooling fluid distribution network, and to convey cooling fluid provided by this network as far as the distribution conduit 45.

The main conduit 47 thus extends between an upstream end, intended to be connected to the cooling fluid distribution network, and a downstream end, connected to the distribution conduit 45.

In particular, the downstream end of the main conduit 47 is connected to the aperture 55 of the distribution conduit 45, through the corresponding aperture of the supply conduit 43.

The main conduit 47 comprises a first portion 47*a* with a cylindrical shape extending in a transverse direction and a second bent portion 47*b* with a circular section, connecting the first portion to the aperture 55 of the distribution conduit 45.

The edges of the aperture 49 are joined up sealably with the main conduit 47, so as to avoid any cooling fluid leak outside the supply conduit 43 via the aperture 49.

Designed in this way, the supply circuit 13 is able to transfer a flow of cooling fluid provided at a pressure of less than or equal to 2 bars by the cooling fluid distribution network as far as the first cooling header 11 so as to obtain, at the outlet of the first cooling header 11, a cooling fluid jet ejected at a velocity of more than 5 m/s, with a surface flow rate comprised between 360 and 2,700 L/min/m2.

In particular, the supply circuit 13 minimizes the pressure drops, which allows obtaining such an ejection velocity from a relatively low pressure. Notably, owing to the configuration of the supply circuit 13 described above, a circulation velocity of the cooling fluid of less than 2 m/s is maintained in this circuit 13, which allows minimization of the pressure drops.

The use of a low pressure, of less than or equal to 2 bars, and for example above 1 bar, minimizes the energy consumption of the cooling apparatus 1, in particular reduces by a factor of about 5 the electric consumption required for the cooling fluid supply as compared with an apparatus in which the pressure of the cooling fluid distribution network would be equal to 4 bars.

The device 15 for stopping the cooling fluid flow is adapted for stopping the cooling fluid flow generated by the first cooling header 11 and thus avoiding that this cooling fluid flow extends over a length of the substrate 1 greater than the predetermined length L.

The device 15 for stopping the cooling fluid flow is positioned downstream from the first cooling header 11 in the running direction of the substrate 1. The device 15 for stopping the cooling fluid flow for example comprises a first roller 61 configured so as to come into contact with the first surface of the running substrate 1, so as to prevent a flow of cooling fluid from the first cooling header 11 beyond the first roller 61 in the running direction of the substrate 1.

The first roller 61 has a general cylindrical shape, and extends transversely over the whole width of the substrate 1.

The first roller 61 is positioned downstream from the first cooling header 11 so that the distance between the impact area of the cooling fluid jet ejected by the first cooling header 11 on the first surface of the substrate 1 and the contact area of the first r roller 61 on the first surface of the substrate 1 is equal to the predetermined distance L.

The second roller 20 is preferably positioned symmetrically to the first roller 61 with respect to the median plane of the running substrate 1.

The additional device 25 for stopping the cooling fluid flow, which in the described example is positioned downstream from the first unit 9 of the second device 8, is intended to prevent any cooling fluid flow downstream from the cooling module 5, beyond the predetermined length L1.

This additional stopping device 25 is positioned downstream from the first roller 61.

The device 25 for example comprises a nozzle configured for sending a pressurized cooling fluid jet onto the substrate 1 in a direction orthogonal to the substrate or opposite to the running direction A of the substrate 1. For example, the angle formed between the running direction A of the substrate and this pressurized cooling fluid jet is comprised between 60° and 90°.

During operation, a substrate 1 is set to run by the rollers 3, 21 and 19, in the running direction A, at a running velocity preferably comprised between 0.5 m/s and 2.5 m/s.

During this running, the substrate 1 circulates in the cooling module 5, in particular in each of the cooling devices 8.

The initial temperature of the substrate 1 during its entry into the cooling module 5 is greater than 600° C., notably greater than 800° C. For example, the initial temperature of the substrate 1 upon its entry into the cooling module 5 is greater than 900° C.

During the running of the substrate 1 in each of the devices 8, a first cooling fluid jet is ejected by the first cooling header 11 on the first surface of the substrate 1 and a second cooling fluid jet is ejected by the second cooling header 17 on the second surface of the substrate 1.

For this purpose, the cooling fluid distribution network supplies each of the cooling fluid supply circuits 13 and 19, under a pressure of less than 2 bars, and preferably above 1 bar.

The cooling fluid flow circulates in each of the circuits 13 and 19 in the main conduit 47 for providing cooling fluid, and then in the distribution conduit 45, and then, via the orifices 57, in the supply conduit 43, over the whole width of this conduit 43.

The cooling fluid flow circulates in each of the circuits 13 and 19 at a velocity of less than or equal to 2 m/s.

The cooling fluid flow then circulates in the channel 35 of each of the first 17 and second 11 headers, and then in the conduit 37 of the header nozzle 33.

The cooling fluid, for which the temperature is preferably less than 30° C., is then ejected as first and second cooling fluid jets through the openings 39 of the first 11 and second 17 headers.

The first and second cooling fluid jets are ejected in the running direction A of the substrate 1 at an ejection velocity of more than or equal to 5 m/s, and preferably less than 12 m/s, by forming on each of the first and lower surfaces of the substrate 1 a laminar flow of cooling fluid substantially parallel to the substrate 1.

This cooling fluid flow extends over the whole width of the substrate 1, over the first predetermined length L1 on the first surface of substrate 1, and over the second predetermined length L2 on the second surface of substrate 1.

Thus, the substrate 1 is cooled from a first temperature down to a second temperature in nucleate boiling.

The first temperature corresponds to the temperature of the substrate 1 at the impact area of the first and second cooling fluid jets, and the second temperature corresponds to the temperature of the substrate 1 at the stopping device 15.

In particular, the temperature of the substrate 1 at the inlet of the first cooling device 8 is equal to the initial temperature of the substrate 1 at the inlet of the cooling module 5. Thus, during its passing in the first cooling device 8, the substrate 1 is cooled from a temperature above 600° C., notably above 800° C., for example above 900° C., under nucleate boiling conditions.

The cooling device and process according to the invention thus allow effectively cooling, in a controlled way, a substrate, without inducing any temperature inhomogeneities within the substrate, in particular between the first surface and the second surface of the substrate.

The inventors have studied, from the apparatus of FIGS. 2 to 4, the effect of the ejection velocity of the cooling fluid on the heat flow extracted from the substrate 1 by the cooling fluid flows on the first and second surfaces of the substrate, depending on the temperature of the substrate 1. This effect is illustrated on FIG. 5.

On this FIG. 5, it is seen that when the ejection velocity of the cooling fluid is less than 5 m/s, for example equal to 2.8 m/s (curve A), the substrate 1 is cooled in nucleate boiling only when the temperature of the substrate 1 is below 370° C.

Under these conditions, the lower the temperature of the substrate 1 or of the area of the cooled substrate 1, the lower the extracted heat flow. Under such conditions, the coldest areas of the substrate 1 are cooled down more slowly, which gives the possibility of attenuating the possible temperature inhomogeneities of the substrate 1.

Nevertheless, when the cooling fluid ejection velocity is equal to 2.8 m/s, the nucleate boiling conditions are only attained when the temperature of the substrate 1 is less than 370° C., and is therefore not obtained from the beginning of the cooling of the substrate 1 after hot rolling or a heat treatment.

Indeed, when the temperature of the substrate 1 is comprised between about 370° C. and 800° C., the substrate 1 is cooled down in transition boiling. Under these conditions, the lower the temperature of the substrate 1 or of the area of the cooled substrate 1, the greater the extracted heat flow. Under such conditions, the coldest areas of the substrate 1 are cooled down more rapidly, which tends to enhance the possible temperature inhomogeneities of the substrate 1.

When the temperature of the substrate 1 is greater than about 800° C., the substrate 1 is cooled in film boiling. Under these conditions, the extracted heat flow is substantially invariant with temperature, but remains less than the heat flow which may be extracted in nucleate boiling, for example at 400° C.

It is therefore seen that when the cooling fluid ejection velocity is less than 5 m/s, for example when this velocity is equal to 2.8 m/s, the cooling conditions which are obtained at the beginning of the cooling, from an initial temperature of more than 600° C., or even more than 800° C. or even 900° C., are the transition boiling conditions, or the film boiling conditions, which are then followed by the transition boiling conditions.

In both of these cases, the substrate 1 is cooled from its initial temperature down to a final temperature at least partly in transition boiling, which tends to exacerbate the temperature inhomogeneities.

When the ejection velocity of the cooling fluid towards the first and second surfaces of the substrate 1 increases, for example when it is equal to 4 m/s (curve B), it is seen that the nucleate boiling conditions are obtained up to a higher temperature (about 400° C.).

Further, in transition boiling, the variation of the extracted heat flow with temperature, i.e. the slope of the representative curve of the extracted heat flow versus temperature, decreases in absolute value.

In other words, when the cooling fluid ejection velocity is equal to 4 m/s, a cooling in transition boiling conditions exacerbates to a lesser extent the temperature inhomogeneities of the substrate 1 than when the cooling fluid ejection velocity is equal to 2.8 m/s.

When the cooling fluid ejection velocity further increases and becomes greater than 5 m/s, notably equal to 6 m/s (curve C) and 7.4 m/s (curve D), the extracted heat flow from the substrate 1 is an increasing function of the temperature of the substrate 1 over a range of temperature which extends as far as temperatures attaining or even exceeding 900°.

Thus, the substrate 1 may be cooled from a temperature above 900° C. down to room temperature exclusively in nucleate boiling.

Figure 5:
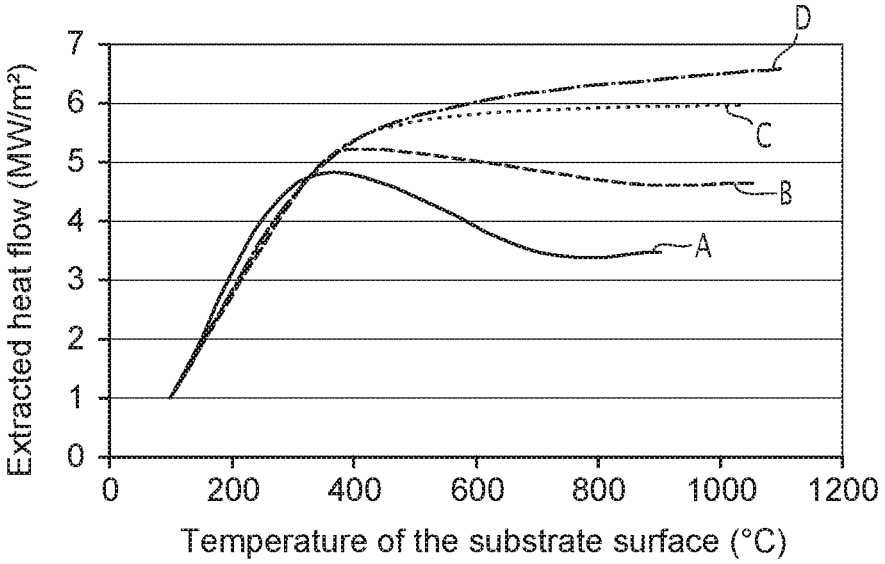
FIG. 5 is a graph illustrating the heat flow extracted from a plate by the cooling module of FIGS. 2 to 4, versus the temperature of the surface of the plate, for different cooling fluid jet ejection rates on the surface of the plate.

FIG. 5 therefore shows that when the ejection velocity of the first and second cooling fluid jets is greater than or equal to 5 m/s, the substrate 1 may be exclusively cooled in nucleate boiling, from an initial temperature greater than 600° C., or even greater than 800° C., or even greater than 900° C.

The substrate 1 may therefore be exclusively cooled under conditions which tend to attenuate the temperature inhomogeneities which the substrate 1 may include before its cooling.

It is further seen in FIG. 5 that the heat flow extracted from the substrate 1, at least in a temperature range between 400° C. and 1,000° C., is all the larger since the ejection velocity of the cooling fluid jets is high.

FIG. 5 thus shows that the ejection of the first and second cooling fluid jets at a velocity of more than or equal to 5 m/s allows obtaining effective cooling of the substrate 1.

The inventors moreover studied the effects of the distance H between the opening 39 and the surface of the substrate 1, and of the angle α formed by the first or lower cooling fluid jet, during its ejection, with the running direction A, on the cooling rate of the substrate 1, for a substrate 1.

These effects are illustrated in Tables 1 and 2 below respectively, and on FIGS. 6 and 7.

In Table 1 are reported the relative cooling rate obtained with different distances H. The relative cooling rates are computed in Table 1 as the ratio of the cooling rate obtained with the distance H to the cooling rate obtained with a distance H=60 mm.

TABLE 1

Effect of the distance H on the cooling rate

| Distance H (mm) | Relative cooling rate |
|---|---|
| 60 | 1 |
| 100 | 0.92 |
| 200 | 0.98 |

In Table 2 is reported the relative cooling rate obtained with different angles α. The relative cooling rates are computed in Table 2 as the ratio of the cooling rate obtained with the angle α to the cooling rate obtained with an angle α=10°.

TABLE 2

Effect of the angle α on the cooling rate

| Angle α (°) | Relative cooling rate |
|---|---|
| 10 | 1 |
| 19 | 1.1 |
| 25 | 0.98 |

Figure 6:
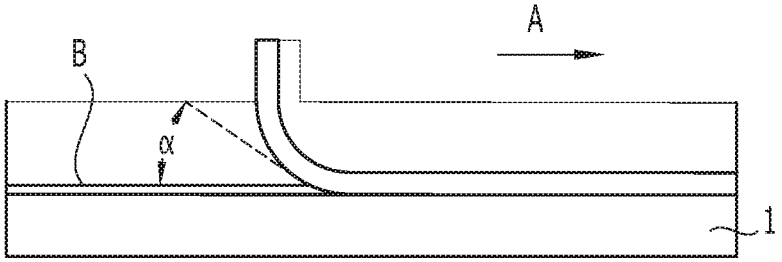
FIGS. 6 and 7 are schematic views illustrating the influence of the angle $\alpha$ formed by the cooling fluid jets with the running direction of the substrate on the fluid flow formed on the surface of the substrate.
Figure 7:
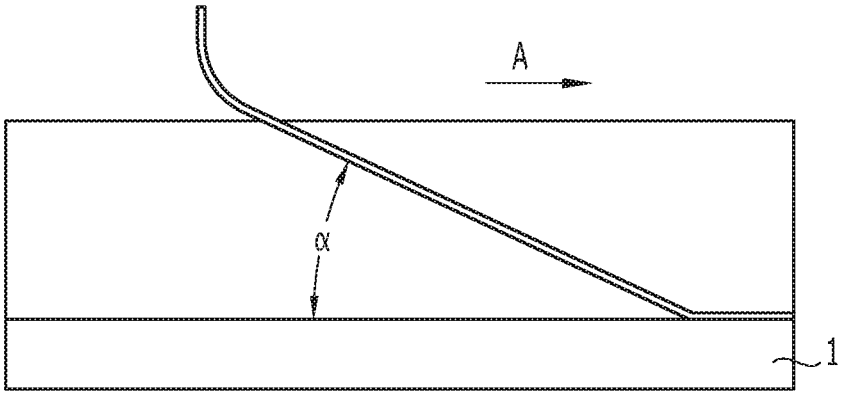

FIGS. 6 and 7 illustrate the fluid flow on a substrate 1 for two different angles α. On FIGS. 6 and 7, only the first surface of the substrate 1 and the cooling fluid jet and flow are shown.

On FIG. 6, the angle α formed by the cooling fluid jet with the longitudinal direction A is of about 35°, i.e. higher than 25°. As shown on FIG. 6, owing to this angle, part of the cooling fluid backflows B opposite the running direction A and, as a result, the cooling fluid flow of the surface of the substrate is disturbed and not laminar, so that the substrate is not cooled exclusively by nucleate boiling, but rather is cooled, as least partially, by transition boiling.

By contrast, on FIG. 7, the angle α formed by the cooling fluid jet with the longitudinal direction A is of 25°. With this angle, no cooling fluid backflows opposite the running direction A. Rather, the cooling fluid flows along the running direction A is laminar, so that the substrate is cooled exclusively by nucleate boiling.

Tests were moreover conducted in order to study the influence of the cooling fluid surface flow rate on the cooling rate, and for comparing the cooling rates obtained with the cooling rate obtained by a process according to the state of the art, with equal surface flow rate.

Table 3 thus illustrates the cooling rate, in ° C./s, obtained by the process according to the invention, between 800° C. and 550° C., versus the thickness of the cooled substrate 1, for a surface flow rate of 3,360 L/s/m2 and for a surface flow rate of 1020 L/s/m2.

These performances are compared with those obtained by a standard process of the prior art, in which cooling fluid jets are ejected orthogonally to the surface of the substrate 1, for cooling fluid surface flow rates of 3360 L/s/m$^2$ and 1020 L/s/m$^2$.

TABLE 3

Cooling rates between 800° C. and 550° C. in function of the thickness of the substrate and the surface flow rate with a process according to the invention and a process according to the prior art

| | Surface Flow rate (L/s/m$^2$) | | | |
|---|---|---|---|---|
| Thickness (mm) | 1020 (invention) | 3360 (invention) | 1020 (prior art) | 3360 (prior art) |
| 5 | 240 | 380 | 50 | 190 |
| 10 | 140 | 180 | 25 | 80 |
| 30 | 40 | 45 | 10 | 25 |
| 60 | 18 | 20 | 5 | 10 |
| 80 | 10 | 10 | 3 | 5 |

Table 3 shows that the cooling rates of the substrate 1 obtained by means of the process according to the invention for the smallest surface flow rate (1,020 L/s/m$^2$) are greater than the cooling rates of the substrate 1 obtained by means of the standard process, in particular at the rates obtained for the largest surface flow rate (3,360 L/s/m$^2$).

These tests thus show that the process according to the invention gives the possibility of obtaining a particularly effective cooling of the substrate 1, without however requiring a larger cooling fluid flow velocity than the exiting processes.

The inventors also studied the cooling profile of the first and second surfaces of a substrate 1 with a thickness of 30 mm, from an initial temperature of about 1,150° C., down to room temperature.

Figure 8:
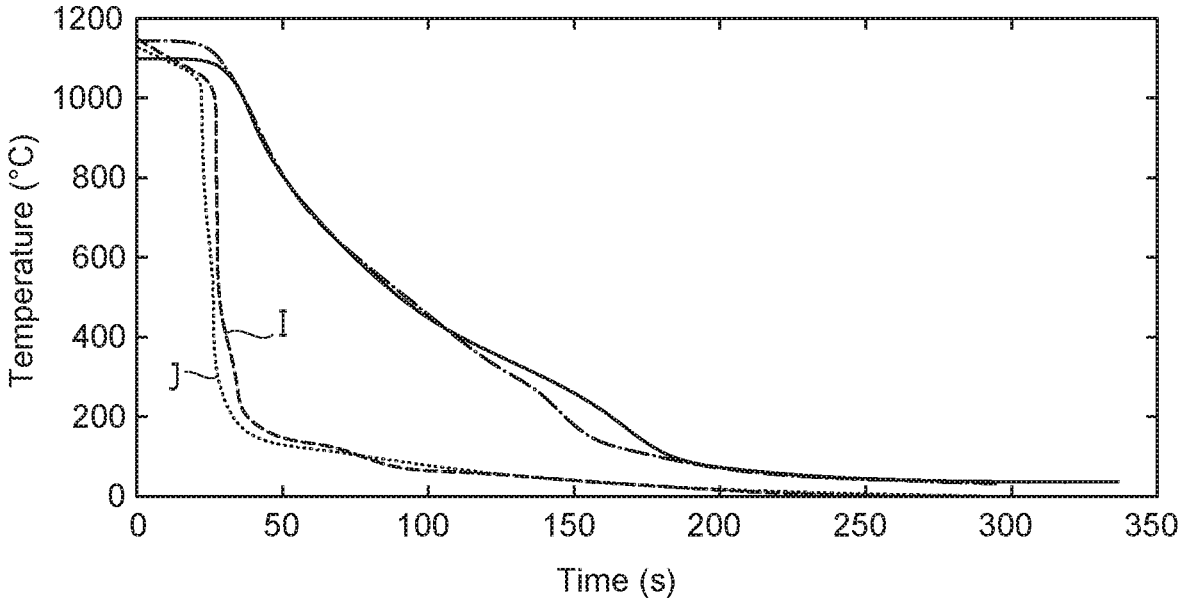
FIG. 8 is a graph illustrating the time-dependent change in the temperature of the upper and lower surfaces of a plate during its cooling by a cooling module according to FIGS. 2 to 4.

FIG. 8 thus illustrates the time-dependent change of the temperature of the first (curve I) and second (curve J) surfaces of the substrate 1, which are upper and lower surfaces, versus time. This Figure shows that the cooling profiles of the first surface and of the second surface of the substrate 1 are similar.

Notably, the ejection of the cooling fluid jets on the second, in this example lower, surface at an ejection velocity greater than or equal to 5 m/s gives the possibility of ensuring that the cooling fluid flow formed on the lower surface of the substrate 1 remains in contact with the lower surface of the substrate 1 over the length L2, which gives the possibility of obtaining symmetrical cooling of the upper and lower surfaces of the substrate 1, therefore homogenous cooling of the substrate 1 in its thickness.

This Figure also shows that the cooling of the substrate 1 is very rapid, the upper surface and the lower surface being cooled from 1,150° to a temperature of less than 200° C. in less than 50 s.

Figure 9:
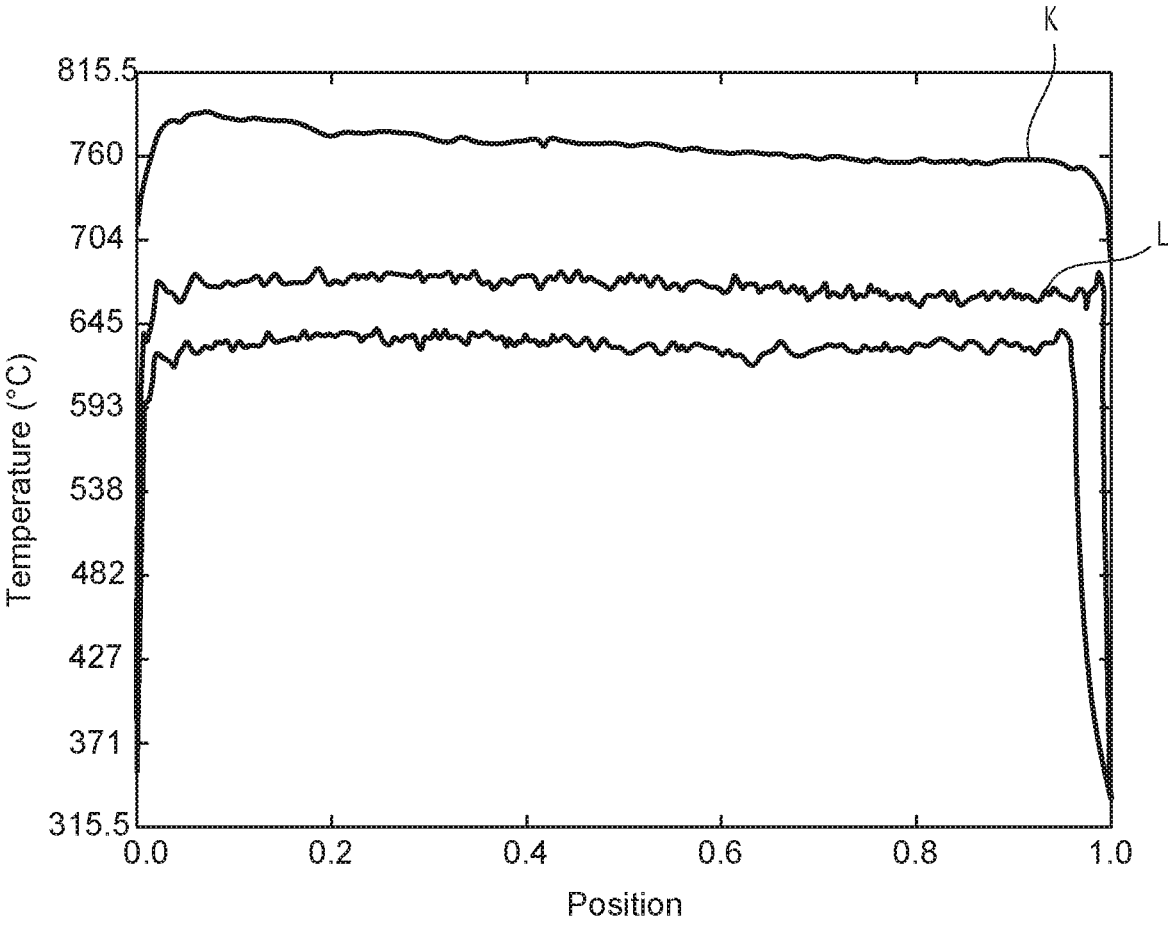
FIG. 9 is a graph illustrating the temperature profile of the surface of a plate in the longitudinal direction, from the head to the tail of the plate, at the inlet and at the outlet of a cooling module of an apparatus according to FIGS. 2 to 4.

FIG. 9 illustrates the distribution of temperature over the surface of the substrate 1 in a longitudinal direction at the inlet of a cooling module 5 as illustrated in FIGS. 2 and 4 (curve K) and at the outlet (curve L) of this module 5.

The abscissa of these curves represents the standardized position of the measurement point on the substrate 1 in the longitudinal direction.

It is thus seen that the substrate 1 has, before its entry into the cooling module 5, a temperature inhomogeneity in the longitudinal direction, between the head and the tail of the substrate 1, and that this inhomogeneity is strongly attenuated at the outlet of the module 5.

FIG. 9 thus illustrates the fact that the substrate 1 is cooled by the module 5 exclusively under nucleate boiling conditions, which allows attenuation of the temperature inhomogeneities initially present between the head and the tail of the substrate 1.

The process according to the invention consequently allows obtaining a substrate 1 having very good flatness qualities.

Figure 10:
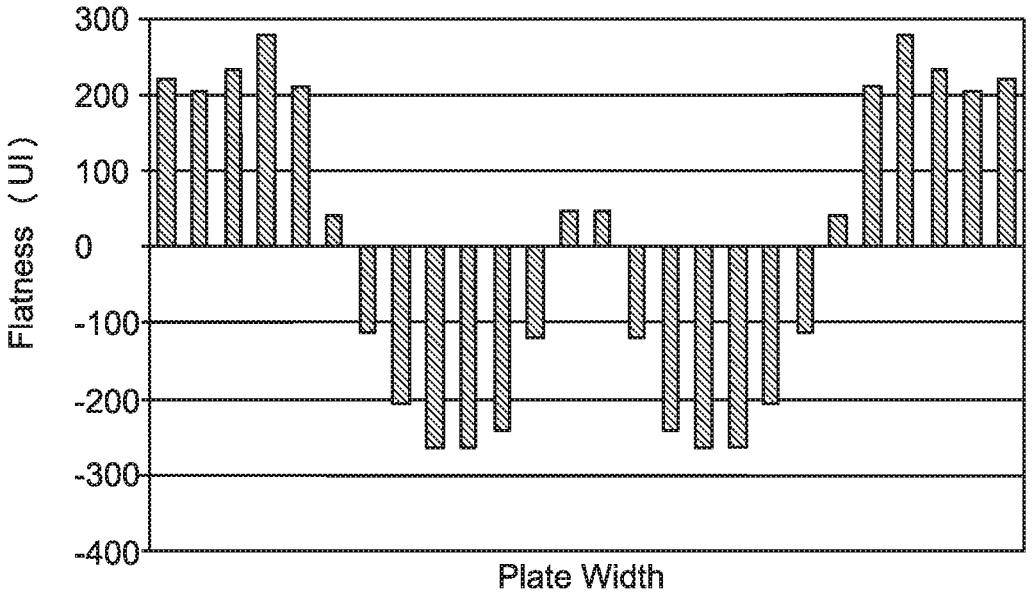
FIG. 10 is a graph illustrating the flatness of a substrate cooled by a process according to the state of the art.
Figure 11:
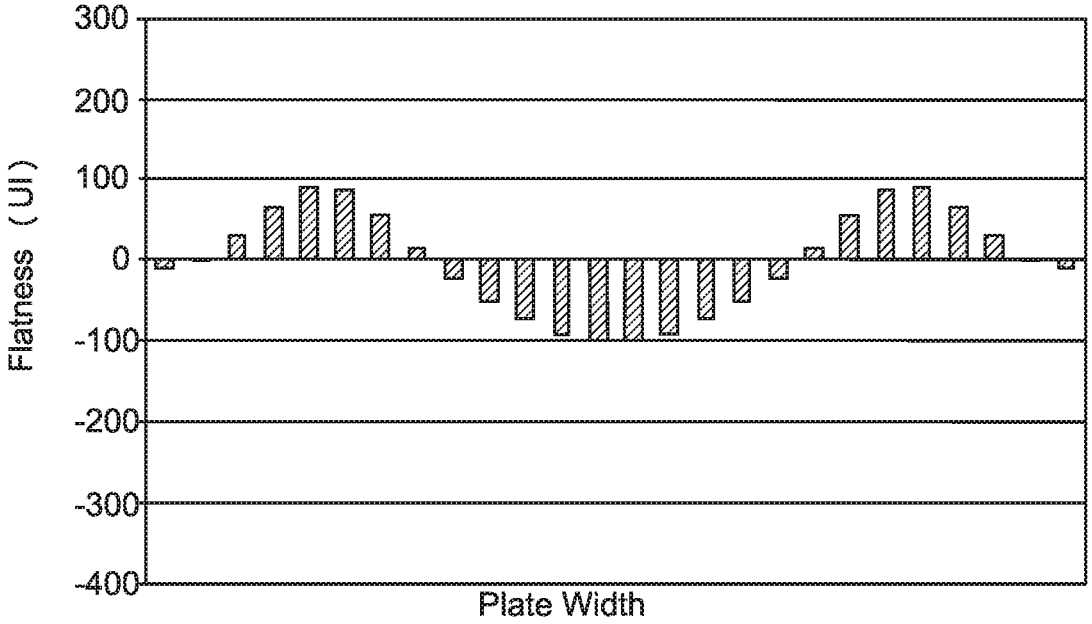
FIG. 11 is a graph illustrating the flatness of a substrate cooled by a process according to the invention.

As an example and comparison, FIGS. 10 and 11 illustrate the profile of the surface of two substrates, over the width of the substrate, cooled either by a cooling process according to the state of the art (FIG. 10) or according to the invention (FIG. 11).

On FIGS. 10 and 11, the x-axis represents the position of measure points over the width of the substrate, and the y-axis reports the flatness on each measure point, expressed as Flatness=(ε11−(ε11) mean)·105, wherein (ε11) mean is the mean value of ε11 over the width of the substrate.

The substrate of FIG. 10 was cooled at least partially by transition boiling, whereas the substrate of FIG. 11 was cooled according to the invention, exclusively by nucleate boiling.

The comparison of these figures shows that the process according to the invention, in which the substrate is cooled by nucleate boiling, allows achieving an improved substrate flatness as compared to the process of the state of the art.

FIGS. 12 and 13 illustrate a cooling header 11' and a supply circuit 13' according to another embodiment of the assembly illustrated on FIGS. 3 and 4.

This embodiment differs from the embodiment described with reference to FIGS. 3 and 4 mainly in that the cooling header 11' does not comprise the channel 35, and in that the supply circuit 13' does not comprise any main conduit 47 for providing cooling fluid.

Thus, in this embodiment, the cooling header 11' is formed with a header nozzle 71.

The header nozzle 71 is functionally similar to the header nozzle 33 described with reference to FIGS. 3 and 4.

In particular, the header nozzle 71 extends in a direction transverse with respect to the running substrate 1, over a width greater than or equal to that of the substrate 1 to be cooled.

The header nozzle 71 is provided with a through-orifice forming a conduit 73 for conveying cooling fluid. The conduit 73 extends transversely over a width greater than or equal to that of the substrate 1 to be cooled, and extends in a vertical longitudinal plane between an upstream end and a downstream end. The upstream end of the conduit 73 is directly connected to the supply circuit 13'. The downstream end forms an aperture, through which cooling fluid, injected by the supply circuit 13' and crossing the conduit 37, is ejected as a cooling fluid jet onto the substrate.

The aperture forms an opening 75, similar to the opening 39 described with reference to FIGS. 3 and 4.

The conduit 73 has a section which decreases from the upstream side to the downstream side of the conduit 73, which allows formation, at the outlet of the opening 75, of a cooling fluid jet ejected at a velocity of at least 5 m/s, from an initial velocity of the cooling fluid, into the supply circuit 13', of less than 2 m/s. Indeed, as described hereafter, a circulation of cooling fluid in the supply circuit 13' at a velocity of less than 2 m/s allows minimization of the pressure drops in this supply circuit 13', and thus reduction in the pressure required for supplying the circuit 13'.

Preferably, the downstream end of the conduit 73 forms an angle $\alpha$ with the running direction A which is comprised between 5° and 25°, notably between 10° and 20°.

Moreover, according to this alternative, the supply circuit 13' comprises a supply conduit 83 of the cooling header 11' and a distribution conduit 85. Thus, a flow of cooling fluid received from the cooling fluid distribution network is conveyed through the distribution conduit 85, and then through the supply circuit 83, as far as the cooling header 11'.

The supply circuit 83 is intended to supply the header nozzle 73 with cooling fluid.

The supply conduit 83 extends transversely over a width substantially equal to that of the header nozzle 73. The supply conduit 83 has the general shape of a cylinder, and comprises a substantially cylindrical side wall and two end walls. Both of these end walls are each provided with a substantially circular through-orifice 87, intended to allow the passing of the supply conduit 83, as described hereafter.

The supply conduit 83 moreover comprises on its side wall, a transverse aperture 89 opening into the conduit 73. The aperture 89 extends transversely over substantially the whole of the width of the supply conduit 83.

The distribution conduit 85 is intended to be connected to the cooling fluid distribution network, and to distribute over the whole width of the supply conduit 83 a cooling fluid flow provided by this distribution network.

The distribution conduit 85 has the general shape of a cylinder, and extends transversely between two ends 85*a*, 85*b*, each connected to the cooling fluid distribution network. The conduit 85 comprises, between the ends 85*a*, 85*b*, a central portion which extends inside the supply conduit 83. Both ends 85*a*, 85*b* open from the supply conduit 83 through the through-orifices 87.

The side wall of the distribution conduit 85 thus defines with the side wall of the supply conduit 83 a space 91 for circulation of cooling fluid inside the supply conduit 83. The space 91 is generally ring-shaped.

The side wall of the distribution conduit 85 is moreover provided with a plurality of orifices 95 intended to allow distribution of cooling fluid from the distribution conduit 85 into the space 91.

The orifices 95 are for example aligned in a transverse direction, and extend over the whole width of the conduit 85.

The orifices 95 are for example equidistant.

According to this alternative, the supply circuit 13' is able to transfer a cooling fluid flow provided at a pressure of less than or equal to 2 bars by the cooling fluid distribution network as far as the cooling header 11' so as to obtain, at the outlet of the cooling header 11', a cooling fluid jet ejected at a velocity of more than 5 m/s, with a surface flow rate comprised between 1,000 and 3,500 L/min/m2.

In particular, the supply circuit 13' allows, like the circuit 13, minimization of the pressure drops, which gives the possibility of obtaining an ejection velocity of more than 5 m/s from a relatively low pressure.

It should be understood that the exemplary embodiments shown above are non-limiting.

In particular, according to another embodiment, the cooling apparatus and module are integrated to a heat treatment line. The cooling apparatus and module are then intended for cooling a substrate 1 in nucleate boiling by quenching the substrate from an initial temperature which is substantially equal to the heat treatment temperature of the substrate, down to room temperature. The initial temperature is for example higher than 800° C., and may even be higher than 100° C.

Besides, although the described module 5 comprises two cooling devices 8, in certain embodiments, the number of devices 8 in a module may vary and be greater than or less than two.

Also, in certain embodiments, the deflectors may be omitted, or the devices may comprise only one upper or only one lower deflector.

Further, in certain embodiments, the device 15 for stopping the cooling fluid flow comprises, in addition to or as a replacement for the roller 61, a nozzle configured for sending a pressurized cooling fluid jet onto the substrate 1 in a direction orthogonal to the substrate or opposite to the running direction of the substrate 1.

What is claimed is:

1. A process of cooling a metal substrate running in a longitudinal direction, said process comprising ejecting at least one first cooling fluid jet on a first surface of the substrate and at least one second cooling fluid jet on a second surface of the substrate, the first and second cooling fluid jets being ejected at a cooling fluid velocity higher than or equal to 5 m/s, so as to form on the first surface of the substrate and on the second surface of the substrate a first laminar cooling fluid flow and a second laminar cooling fluid flow respectively, the first and second laminar cooling fluid flows being tangential to the substrate, the first and second laminar cooling fluid flows extending over a first predetermined length and a second predetermined length of the substrate respectively, the first and the second cooling fluid jets each forming during their ejection a predetermined angle with the longitudinal direction, said predetermined angle being comprised between 5° and 25° and said first and second predetermined lengths being determined so that the substrate is cooled from a first temperature to a second temperature by nucleate boiling.

2. The process according to claim 1, wherein a difference between the first predetermined length and the second predetermined length is lower than 10% of a mean of the first and the second predetermined lengths.

3. The process according to claim 1, wherein the first cooling fluid jet and the second cooling fluid jet are symmetrical with respect to a median plane of the substrate.

4. The process according to claim 1, wherein said first and said second cooling fluid jets are ejected from a predetermined distance on said first and second surfaces respectively, said predetermined distance being comprised between 50 and 200 mm.

5. The process according to claim 1, wherein each of said first and second predetermined lengths is comprised between 0.2 m and 1.5 m.

6. The process according to claim 1, wherein the first temperature is higher than or equal to 600° C.

7. The process according to claim 6, wherein the first temperature is higher than or equal to 800° C.

8. The process according to claim 1, wherein the substrate is running at a speed comprised between 0.2 m/s and 4 m/s.

9. The process according to claim 1, wherein a mean heat flux extracted from each of the first and second surfaces during the cooling from the first temperature to the second temperature is comprised between 3 and 7 $MW/m^2$.

10. The process according to claim 1, wherein, the substrate has a thickness comprised between 2 and 9 mm, and the substrate is cooled from 800° C. to 550° C. at a cooling rate higher than or equal to 200° C./s.

11. The process according to claim 1, wherein each of said first and second cooling fluid jets is ejected with a specific cooling fluid flow rate comprised between 360 and 2700 $L/min/m^2$.

12. The process according to claim 1, wherein the substrate is a steel plate.

13. The process according to claim 1, wherein, the substrate has a width, and said first and second laminar cooling fluid flows extend over the width of the substrate.

14. A method for hot-rolling a metal substrate, said method comprising hot-rolling the metal substrate and cooling the hot-rolled metal substrate with a process according to claim 1.

15. A method for heat-treating a metal substrate, said method comprising heat-treating the metal substrate and cooling the heat-treated metal substrate with a process according to claim 1.

* * * * *